US008277620B2

(12) United States Patent
Bourgeois

(10) Patent No.: US 8,277,620 B2
(45) Date of Patent: Oct. 2, 2012

(54) ELECTROLYZER MODULE FORMING METHOD AND SYSTEM

(75) Inventor: Richard Scott Bourgeois, Albany, NY (US)

(73) Assignee: General Electric Company, Schenectady, NY (US)

( * ) Notice: Subject to any disclaimer, the term of this patent is extended or adjusted under 35 U.S.C. 154(b) by 1000 days.

(21) Appl. No.: 12/242,793

(22) Filed: Sep. 30, 2008

(65) Prior Publication Data

US 2010/0081047 A1 Apr. 1, 2010

(51) Int. Cl.

| | |
|---|---|
| ***C25B 9/08*** | (2006.01) |
| ***C25C 7/00*** | (2006.01) |
| ***C25C 7/02*** | (2006.01) |
| ***C25C 7/04*** | (2006.01) |
| ***B28B 1/44*** | (2006.01) |
| ***B28B 21/42*** | (2006.01) |

(52) U.S. Cl. ..... 204/257; 204/255; 204/254; 204/253; 204/252; 264/629; 264/632; 264/512; 264/516; 264/531; 264/249

(58) Field of Classification Search ..... 204/252, 204/523, 254, 255, 257; 264/629, 632, 511, 264/512, 514, 515, 516, 526, 531, 533, 544, 264/545, 553, 171.28, 249

See application file for complete search history.

(56) References Cited

U.S. PATENT DOCUMENTS

| | | | | |
|---|---|---|---|---|
| 4,090,939 | A | | 5/1978 | Nicolas et al. |
| 4,135,996 | A | | 1/1979 | Bouy et al. |
| 4,144,161 | A | | 3/1979 | Bourgeois |
| 4,243,497 | A | | 1/1981 | Nicholas et al. |
| 4,339,324 | A | * | 7/1982 | Haas ..... 204/270 |
| 4,547,411 | A | | 10/1985 | Bachot et al. |
| 4,695,489 | A | | 9/1987 | Zarnoch et al. |
| 4,758,322 | A | * | 7/1988 | Sioli ..... 204/255 |
| 5,500,583 | A | | 3/1996 | Buckley et al. |
| 5,667,537 | A | * | 9/1997 | Richiardone et al. ..... 29/623.2 |
| 6,632,347 | B1 | | 10/2003 | Buckley et al. |
| 6,652,731 | B2 | | 11/2003 | Cobley et al. |
| 6,736,954 | B2 | | 5/2004 | Cobley et al. |
| 6,773,573 | B2 | | 8/2004 | Gabe et al. |
| 6,911,068 | B2 | | 6/2005 | Cobley et al. |
| 7,188,478 | B2 | | 3/2007 | Bourgeois |
| 7,303,660 | B2 | | 12/2007 | Buckley et al. |
| 7,381,313 | B2 | | 6/2008 | Libby et al. |

(Continued)

OTHER PUBLICATIONS

U.S. Appl. No. 12/136,331, filed Jun. 6, 2008, Zappi et al.

(Continued)

*Primary Examiner* — Bruce Bell
(74) *Attorney, Agent, or Firm* — Fletcher Yoder

(57) ABSTRACT

Embodiments of the present techniques provide electrolyzers made using thermoformed electrode assemblies and diaphragm assemblies. Each electrode assembly is made from two plastic rings and an electrode plate using a twin sheet thermoforming technique. A first plastic ring is laid in a mold having the appropriate shape to form the electrode assembly. The electrode plate is laid on top of the first plastic ring and is generally centered on the ring. The second plastic ring is laid over the electrode plate, and is generally centered over the electrode plate. The plastic is heated to soften the plastic, and a vacuum is pulled on the mold to pull the softened plastic into the shape of the mold. The mold is closed over the assembly to seal the two plastic rings together. After cooling, the molded part may be removed, resulting in a hollow plastic rim surrounding an electrode plate.

18 Claims, 8 Drawing Sheets

U.S. PATENT DOCUMENTS

| | | | | |
|---|---|---|---|---|
| 2004/0040862 | A1 * | 3/2004 | Kosek et al. | 205/637 |
| 2004/0118677 | A1 * | 6/2004 | Streckert et al. | 204/237 |
| 2006/0053792 | A1 | 3/2006 | Bourgeois | |
| 2006/0131167 | A1 * | 6/2006 | Ramisch et al. | 204/253 |
| 2006/0228619 | A1 | 10/2006 | Bowen et al. | |
| 2007/0000789 | A1 | 1/2007 | Libby et al. | |
| 2007/0122339 | A1 | 5/2007 | Kulkarni et al. | |
| 2007/0278108 | A1 | 12/2007 | Rosenzweig et al. | |
| 2008/0083614 | A1 | 4/2008 | Swalla et al. | |
| 2008/0145746 | A1 | 6/2008 | Zappi et al. | |
| 2008/0145749 | A1 | 6/2008 | Lacovangelo et al. | |
| 2008/0145755 | A1 | 6/2008 | Lacovangelo et al. | |

OTHER PUBLICATIONS

U.S. Appl. No. 12/136,383, filed Jun. 10, 2008, Swalla et al.
U.S. Appl. No. 12/136,439, filed Jun. 10, 2008, Swalla.
Electronic Development Labs, Inc., EDL Tool & Die, Typical Linear coefficient of expansion for common Plastics, http://www.edl-inc.com/Plastic%20expansion%20rates.htm, printed Aug. 1, 2008.
Handy Harman Canada, Comparisons of Materials: Coefficient of Thermal Expansion, http://www.handyharmancanada.com/TheBrazingBook/comparis.htm, printed Oct. 9, 2008.
Wikipedia, The Free Encylopedia, Thermal Expansion, http://en.wikipedia.org/wiki/Thermal_expansion, printed Aug. 1, 2008.

* cited by examiner

ELECTROLYZER MODULE FORMING METHOD AND SYSTEM

BACKGROUND

The present disclosure relates generally to techniques for forming cells to be used in electrolyzer stacks. More specifically, techniques for forming cells using plastic forming techniques are disclosed.

Electrochemical devices are useful in chemical reactions in which electrons may participate as reactants or products. For example, an electrolytic cell may use electrical energy to split lower energy reactants into higher energy products, which may then be used as materials, reactants, or in power generation. In another example, voltaic cells and fuel cells may be used to chemically combine higher energy products to form lower energy products, releasing electrons that may be used to power other devices. While in voltaic cells, the electrode may be consumed during the reaction, in a number of other electrochemical devices, such as electrolytic cells and fuel cells, the electrode is not intended to be a reactant, but merely to catalyze the reaction and collect or donate the current from the reaction.

Electrolytic cells may be useful in a number of processes, such as the splitting of water into oxygen and hydrogen in an electrolyzer. The hydrogen generated may be used in chemical processes, such as hydroformulation or hydrocracking in refineries, or may be stored for later use, such as in the generation of energy in a fuel cell. Electrolyzers may be assembled from a stack of individual plastic components that are joined together to form a contiguous structure, generally by adhesives or welding.

Generally, making the individual components from plastics is desirable, as plastics are both easily formed and insulating. Currently, such cells may be made by or machining individual components than assembling these components into larger units. However, as electrolyzers become larger, such techniques may be problematic. Accordingly, simpler techniques for forming the electrolyzer components would be desirable.

BRIEF DESCRIPTION

An embodiment of the present techniques provides a method of making an electrolyzer. The method includes forming an electrode assembly by thermoforming two rings around an electrode plate.

Another embodiment provides an electrolyzer. The electrolyzer includes a plurality of electrolyzer cells placed adjacent to one another to form a stack. Each electrolyzer cell includes a thermoformed electrode assembly and a diaphragm assembly. The thermoformed electrode assembly includes a formed plastic rim surrounding an electrode plate. The diaphragm assembly of each electrolyzer cell is placed adjacent to a thermoformed electrode assembly of another electrolyzer cell. An aperture in the plastic rim of each thermoformed electrode assembly leads to an exterior surface of the stack, wherein the aperture is configured to equalize a pressure on the exterior surface of the stack with a pressure on a hollow space within the plastic rim. A fluid channel through the stack is formed by an internal structure of each of the electrolyzer cells, wherein the fluid channel comprises an inlet for introducing electrolyte solution into the stack, an outlet for removing a gas formed in the stack, or any combinations thereof.

A third embodiment provides a method of assembling an electrolyzer that includes forming an electrode assembly by thermoforming two rings around an electrode plate. A plurality of electrolyzer cells is assembled into an electrolyzer stack, wherein each electrolyzer cell comprises an electrode assembly and a diaphragm assembly. A shell is disposed around the electrolyzer stack, wherein the shell has an outlet aligned with a fluid channel in the stack.

DRAWINGS

These and other features, aspects, and advantages of the present invention will become better understood when the following detailed description is read with reference to the accompanying drawings in which like characters represent like parts throughout the drawings, wherein.

DETAILED DESCRIPTION

As discussed in detail below, the present techniques provide systems and methods for thermoforming electrolyzer cell assemblies that may be used to form electrolyzer stacks that may be used in electrolyzers. Each electrolyzer cell is formed by joining two sub-assemblies, an electrode assembly and a diaphragm assembly. The electrode assembly has a plastic rim that holds an electrode plate in the center. The electrode plate is a metal plate that functions as a bipolar electrode in the electrolyzer cell. The diaphragm assembly has a plastic rim holding a liquid permeable membrane in the center. The liquid permeable membrane allows electrolyte solution and ions to flow from the anodic surface of an electrode plate in an electrolyzer cell to the cathodic surface of the electrode plate in an adjoining cell, while preventing the mixing of gases formed at each surface. The electrode assembly and the diaphragm assembly may be formed by any number of techniques, such as machining the assemblies from single blocks of plastic, injection molding, and the like. However, these techniques become difficult and/or wasteful as the size of an electrolyzer is increased. Further, the techniques may not scale well for mass production of electrolyzers.

In a contemplated embodiment of the present techniques, the electrode assembly may be made from two plastic rings and an electrode plate using a twin sheet thermoforming technique. The technique may be performed by continuous extruding a plastic sheet, and then cutting plastic rings of substantially the same inner and outer diameters from the plastic sheet. A first plastic ring is laid in a mold having the appropriate shape to form the electrode assembly. The electrode plate is placed over the first plastic ring and is generally centered on the ring. The second plastic ring is placed over the electrode plate and is generally centered over the electrode plate. The plastic is heated and softened and a vacuum is pulled on the mold to pull the softened plastic into the shape of the mold. The mold is closed over the assembly to seal the two plastic rings together. The resulting electrode assembly has a plastic rim surrounding an electrode plate. As a hollow space is formed between the two plastic sheets, one or more apertures may be formed in the outer circumference of the plastic rim to equalize the pressure between the hollow space and the exterior of the electrode assembly. This may help to prevent the electrode assembly from collapsing once it is assembled into an electrolyzer stack. The diaphragm assembly may also be thermoformed. However, the diaphragm assembly will generally be a single plastic rim with the liquid permeable membrane attached to one face. Accordingly, a single sheet thermoforming technique may be used for forming the plastic rim, followed by joining the liquid permeable to the face of the plastic rim.

Figure 1:
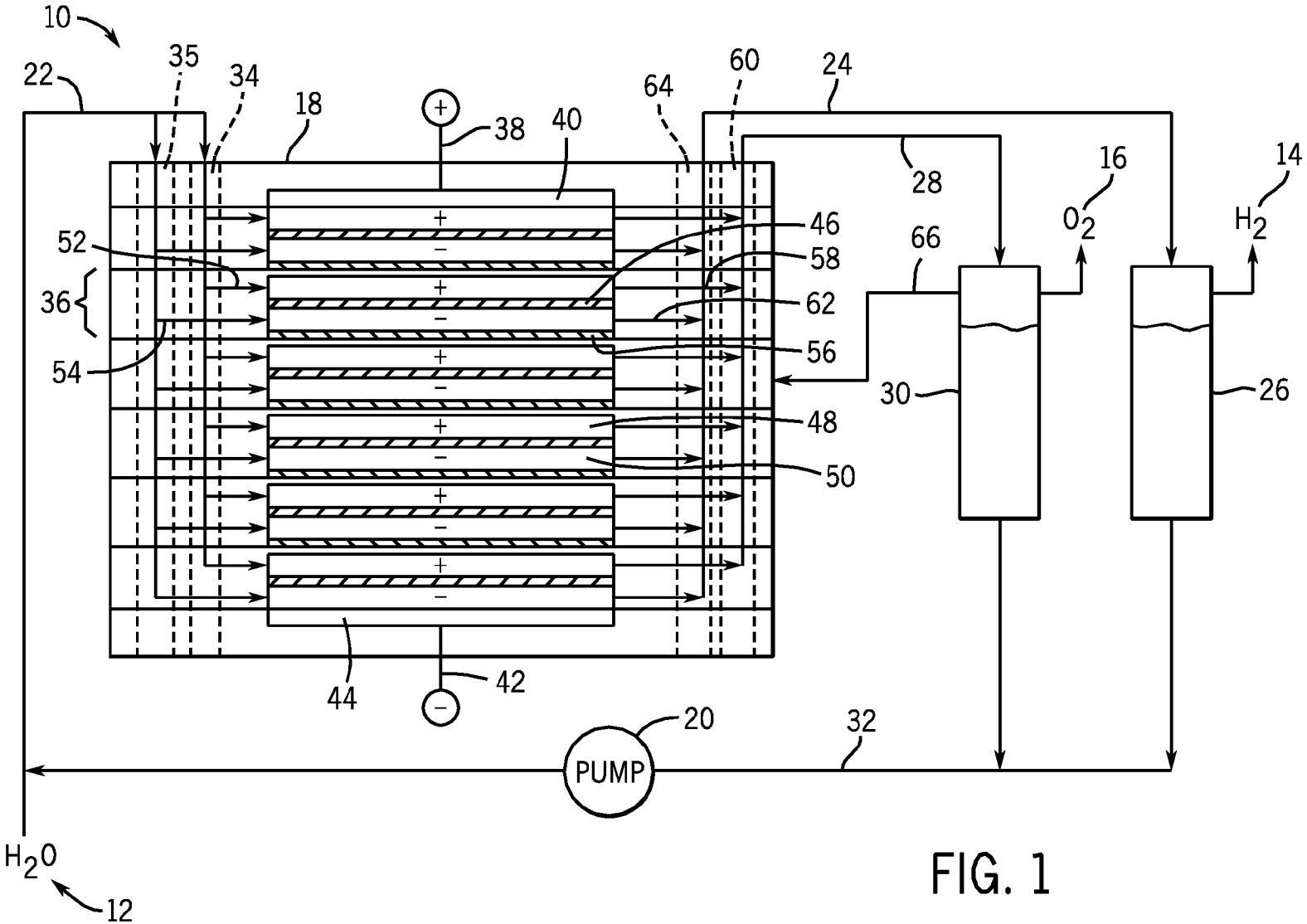
FIG. 1 is a diagrammatic representation of an electrolyzer system according to embodiments of the present techniques.

To further protect the hollow rim of the electrode assembly from damage, such as allowing for thermal expansion during operation, the electrolyzer stack may be mounted within a shell leaving a space between the electrolyzer stack and the shell. The space around the circumference of the electrolyzer stack may be adjusted to allow the stack to contact the shell at around the normal operating temperature of the electrolyzer, allowing the stack to expand during the temperature increase from ambient to the normal operating temperature. The space between the electrolyzer stack and the shell may be filled with a non-conductive fluid which is generally in fluidic contact through the apertures with the hollow spaces in the electrode assembly. The non-conductive fluid may be pressurized to match the internal pressure in the electrolyzer stack. For example, the non-conductive fluid may be fluidically coupled to a gas outlet from the electrolyzer stack, which would match the internal pressure in the electrolyzer stack to the pressure on the exterior surface of the electrolyzer stack and thus with the hollow spaces in the rim. As the electrolyzer stack expands in the radial direction, the pressure matched fluid would be forced from the space between the electrolyzer stack and the shell, and thus protect the electrolyzer stack from hoop stress. In this way, contact with the interior surface of the shell, which may lead to permanent deformations due to restrained thermal expansion, may be avoided An example of an electrolyzer system 10 that may be assembled by the present techniques is illustrated by the schematic diagram of FIG. 1. In the electrolyzer system 10, water 12 is split into hydrogen 14 and oxygen 16 by an electrolyzer stack 18. In operation, a pump 20 maintains a continuous flow of an electrolyte solution 22 through the electrolyzer stack 18. Generally, the electrolyte solution 22 is an aqueous solution of about 20 wt % to about 40 wt. %, or about 30 wt %, potassium hydroxide (KOH) or sodium hydroxide (NaOH), although any number of other ionic solutions may be used. For example, the electrolyte solution 22 may contain lithium hydroxide or other metals.

As a portion of the water 12 is converted to hydrogen 14 and oxygen 16, additional water 12 is added prior to returning the electrolyte solution 22 to the electrolyzer stack 18. As discussed in further detail below, the electrolyzer stack 18 produces a hydrogen stream 24 containing bubbles of hydrogen 14 in the electrolyte solution 22. The hydrogen stream 24 is directed to a hydrogen separator 26, where the hydrogen 14 separates out and is collected for storage or use. The electrolyzer stack 18 also produces a separate oxygen stream 28 containing bubbles of oxygen 16 in the electrolyte solution 22, which is directed to an oxygen separator 30. In the oxygen separator 30, the oxygen 16 is separated from the electrolyte solution 22. The hydrogen separator 26 and oxygen separator 30 may generally function as reservoirs for the electrolyte solution 22. From the separators 26, 30, a return electrolyte solution 32 may be directed to the pump 20, where it is circulated to the electrolyzer stack 18.

In the electrolyzer stack 18, two inlet channels 34, 35 direct the electrolyte solution 22 to a number of individual electrolyzer cells 36. The inlet channels 34, 35 are formed by adjacently aligned apertures formed in each of the electrolyzer cells 36. The electrolyzer cells 36 are stacked and electrically connected in series by the electrolyte solution 22. Generally, the electrolyzer cells 36 are joined, for example, by welding, to form a single structure, in which the inlet channels 34, 35 form one of two sets of flow paths through the structure. However, embodiments of the present techniques allow for assembling an electrolyzer stack 18 without forming a permanent bond between the electrolyzer cells 36 by placing the electrolyzer stack 18 under pressure during assembly and use. This holds the electrolyzer cells 36 together with sufficient pressure to form a hermetic seal between the individual electrolyzer cells 36. Further, these techniques may allow the electrolyzer stack 18 to be serviced by the replacement of or access to individual cells 36.

In the illustrated embodiment, the electrolyzer stack 18 contains 6 electrolyzer cells 36, although any number may be included, such as 10, 50, 75, 100, or more electrolyzer cells 36 depending on the current available and the production rates desired. At one end of the electrolyzer stack 18, a positive source 38 is connected to a positive current collector 40. At the other end of the electrolyzer stack 18, a negative source 42 is connected to a negative current collector 44. An electrode plate 46 disposed within each of the electrolyzer cells 36 functions as a bipolar electrode. As current is passed through the electrolyte solution 22, a positive charge is induced on the side of the electrode plate 46 closest to the positive electrode 38, forming an anodic surface 48. Similarly, a negative charge is induced on the side of the electrode plate 46 closest to the negative electrode, forming a cathodic surface 50. The electrode plate 46 may have a metal member, such as a wire mesh, a wire gauze, a porous metal layer, or any combinations thereof, attached to the surfaces 48, 50 to increase the surface area. The electrode plate 46, the metal member, or any combinations thereof, may be made from stainless steel, nickel, gold, or any other metal that will resist corrosion from the solutions used.

Generally, during electrolysis the difference in charge between the anodic surface 48 and cathodic surface 50 may be on the order of about 1.5 volts to about 2.2 volts. Accordingly, as the electrolyzer cells 36 are in series, the voltage supplied to the electrolyzer stack 18 will be increased to accommodate the number of electrolyzer cells 36 in the electrolyzer stack 18. For example, the voltage supplied to the electrolyzer stack 18 may range from about 15 to about 22 volts, for embodiments with 10 electrolyzer cells 36 and range from about 150 volts to about 220 volts, for embodiments with 100 electrolyzer cells 36. Other voltages, and indeed, other charge application schemes may also be envisaged.

During operation of the electrolyzer stack 18, the electrolyzer solution 22 is passed over the anodic surface 48 of the electrode plate 46 through an anodic surface inlet channel 52 formed in each of the electrolyzer cells 36 and connected to the anodic inlet channel 34. A cathodic surface inlet channel 54 directs electrolyte solution 22 from the cathodic inlet channel 35 over the cathodic surface 50 of the electrode plate 46. The water 12 in the electrolyte solution 22 is split into oxygen 16 at the anodic surface 48 and hydrogen 14 at the cathodic surface 50. The bubbles of hydrogen 14 and oxygen 16 are isolated from each other by a liquid permeable membrane 56, which allows water and ions from the electrolyte solution 22 to flow and conduct current between the anodic surface 48 and the cathodic surface 50, but generally prevents the transfer of gas. The liquid permeable membrane 56 may be made from any number of hydrophilic polymers, including, for example, polysulfones, polyacrylamides, and polyacrylic acids, among others.

The oxygen stream 28 formed at the anodic surface 48 in each of the electrolyzer cells 36 is directed through an anodic surface outlet channel 58 to an oxygen outlet channel 60. From the oxygen outlet channel 60, the oxygen stream 28 is directed to the oxygen separator 30. Similarly, the hydrogen stream 24 formed at the cathodic surface 50 of each of the electrolyzer cells 36 is directed through a cathodic surface outlet channel 62 to a hydrogen outlet channel 64. From the hydrogen outlet channel 64, the hydrogen stream 24 is directed to the hydrogen separator 26. As for the inlet channels 34, 35, the electrolyzer cells 36 have adjacently aligned apertures that form the outlet channels 60, 64 when electrolyzer cells 36 are joined together to form the final structure. Accordingly, it is desirable that the electrolyzer cells 36 be hermetically sealed to each other to prevent mixing of the hydrogen 14 and oxygen 16 between the outlet channels 60, 64, or other parts of the electrolyzer stack 18.

As discussed above, the pressure on the inside of the electrolyzer stack 18 may be equalized with pressure outside of the electrolyzer stack 18 and thus with the hollow space in the plastic rim. This may be performed in any number of ways. For example, in a contemplated embodiment, a fluidic coupling 66 may be made with the gas in the oxygen reservoir 30 to a space surrounding the electrolyzer stack 18, as discussed below. As the oxygen reservoir 30 is generally at the same pressure as the inside of the electrolyzer stack 18, this would maintain the pressure within the space outside of the electrolyzer stack 18 at the same pressure as the inside. Further, the apertures formed in each of the plastic rims of the electrode assemblies would allow the pressure outside of the electrolyzer stack 18 to equalize with the pressure in the hollow space of each rim. The fluidic coupling 66 does not have to be made to the oxygen reservoir 30, but could be to the hydrogen reservoir 26, or to either of the outlet streams 24, 28. The back pressure on the stack may be maintained by outlet valves (not shown) located on the outlet lines from the reservoirs 30, 26. As the reservoirs 30, 26 will generally be held at the same pressures, the outlet valves may be two sides of a single multi-gang valve, generally allowing both outlet valves to be adjusted together.

Figure 2:
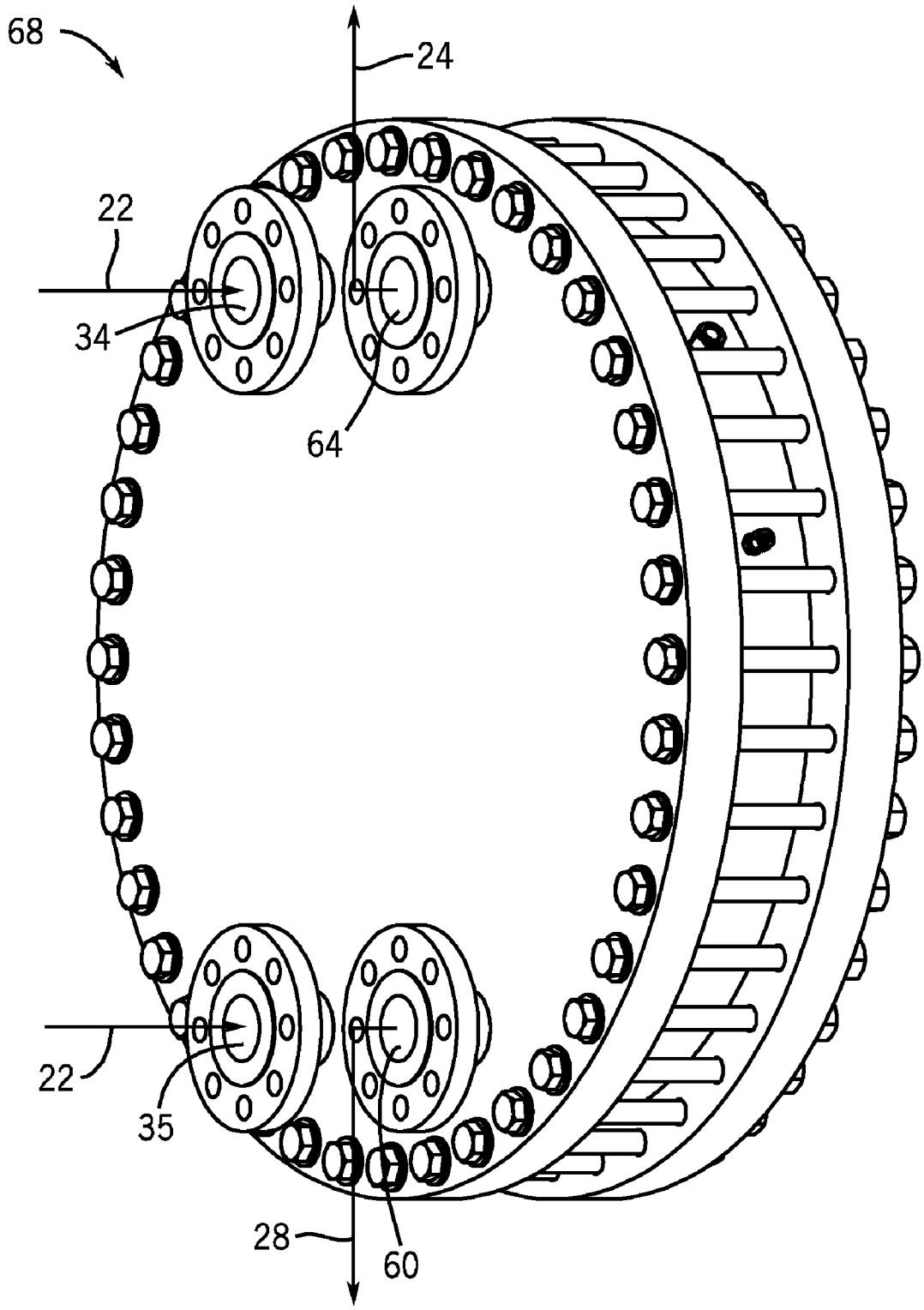
FIG. 2 is a perspective view of an exemplary assembled electrolyzer.

The electrolyzer stack 18 is generally mounted in an enclosure as illustrated in FIG. 2, forming an electrolyzer 68. The electrolyzer 68 has connections for the inlet channels 34, 35 to allow the flow of electrolyte solution 22 into the electrolyzer 68. The electrolyzer 68 also has connections for the oxygen outlet channel 60 to allow the oxygen stream 28 to be removed, and the hydrogen outlet channel 64 to allow the hydrogen stream 24 to be removed. In the illustrated embodiment, the structure forms a pressure vessel, and the connections are flanged connections for interfacing with mating piping. Other physical configurations may, of course, be envisaged.

Figure 3:
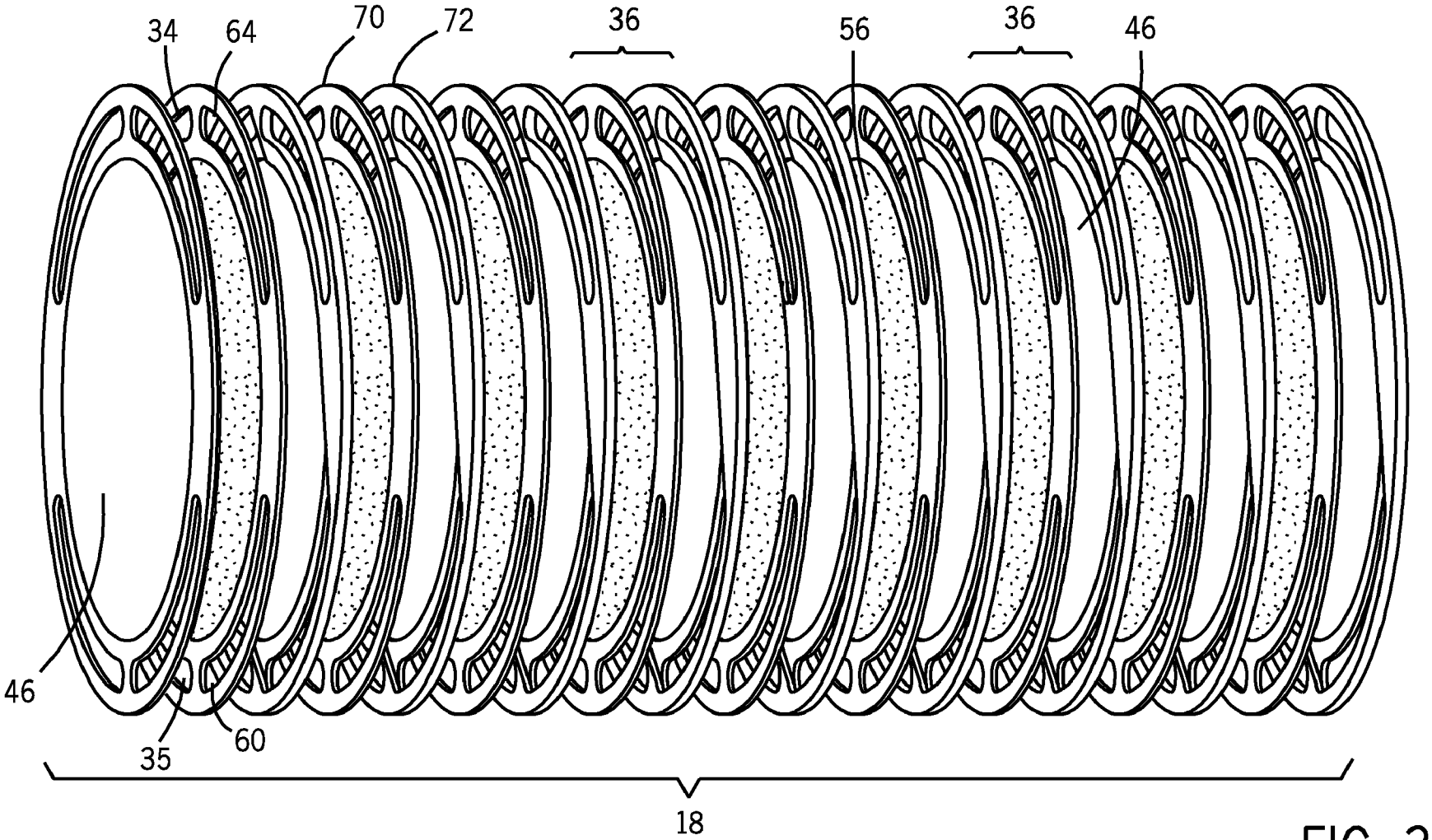
FIG. 3 is an exploded view of an electrolyzer stack configured to be used in the electrolyzer of FIG. 2, showing the individual parts of the stack assembly.

An electrolyzer stack 18 that may be used in the electrolyzer 68 is shown in the expanded view of FIG. 3. As shown in FIG. 3, diaphragm assemblies 70 and electrode assemblies 72 may be aligned and stacked together to form the electrolyzer stack 18. The assemblies 70, 72 are generally joined into electrolyzer cells 36 before being formed into the stack, but the individual assemblies 70, 72 may be stacked together without first forming electrolyzer cells 36. During assembly, each electrode assembly 72 is placed adjacent to the diaphragm assembly 70 of the adjoining electrolyzer cell 36. Thus, each electrode plate 46 is placed between two liquid permeable membranes 56, generally preventing mixing of gases formed at each surface of the electrode plate 46. The apertures in each of the electrolyzer cells 36 are aligned to form the inlet channels 34, 35 and outlet channels 60, 64. The alignment of the electrolyzer cells 36 may be performed by inserting one or more alignment bars (not shown) through the channels 34, 35, 60, and 64. Further, the electrolyzer cells 36 may be aligned by mating protrusions (not shown) in the surface of each electrolyzer cell 36 with corresponding indentations on an adjoining electrolyzer cell 36.

Figure 4:
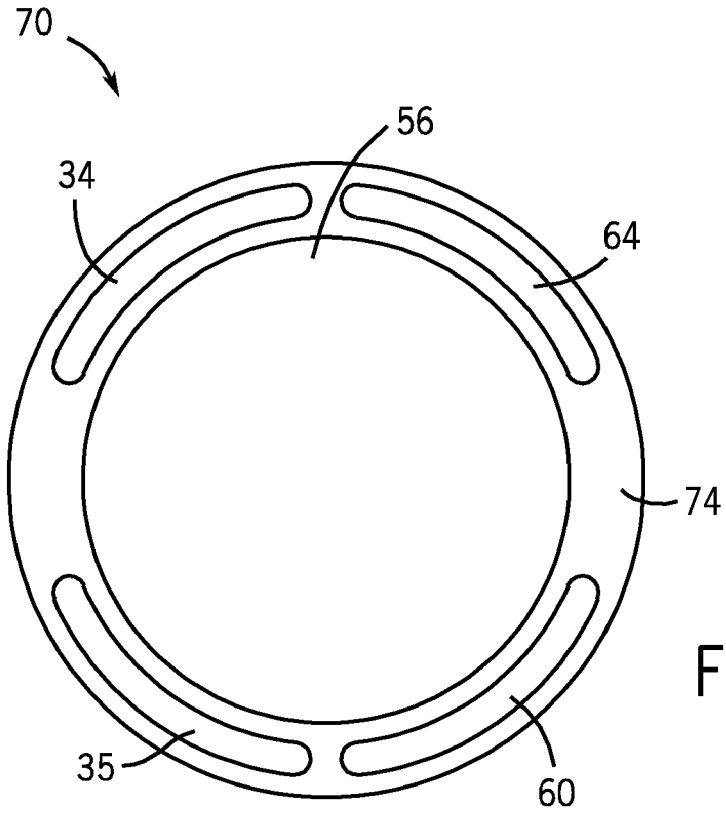
FIG. 4 is a front view of a diaphragm assembly according to embodiments of the present techniques.

A front view of an individual diaphragm assembly 70 that may be used in an electrolyzer cell 36 is shown in FIG. 4. The diaphragm assembly 70 may be made from a single plastic ring molded into a rim 74. The liquid permeable membrane 56 is attached to one surface of the rim 74. For example, the liquid permeable membrane 56 may be glued or heat sealed to the rim. Other techniques for joining a membrane to a plastic surface, such as ultrasonic welding, may also be used, and are within the scope of the present techniques. The rim 74 will have molded apertures that will form the fluid channels 34, 35, 60, and 64 when placed in aligned contact with adjoining electrode assemblies 72.

Figure 5:
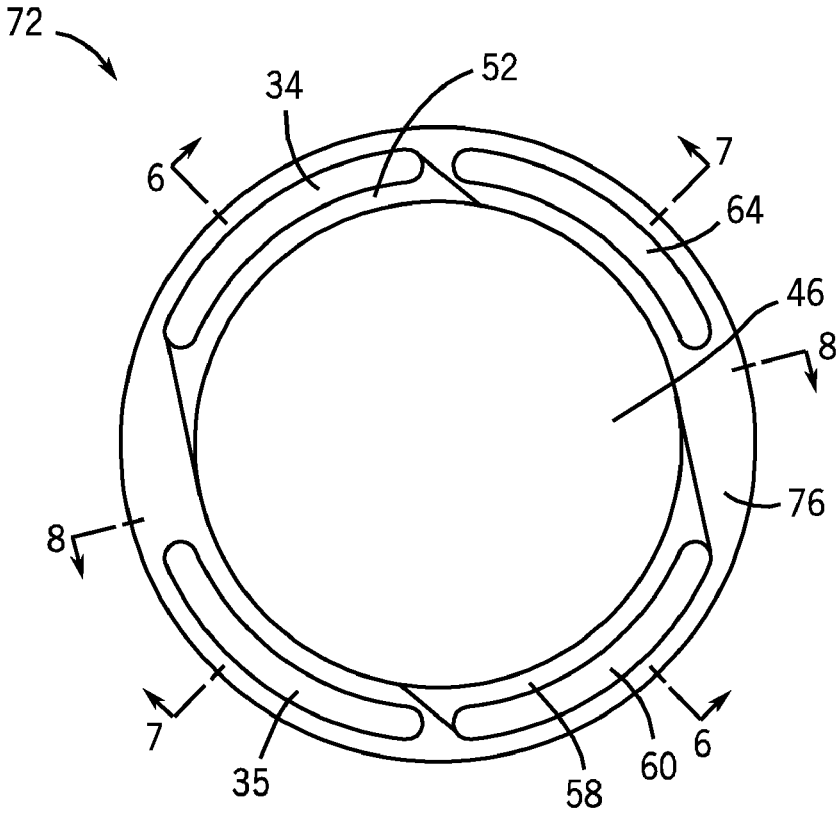
FIG. 5 is a front view of an electrode assembly according to embodiments of the present techniques.

A front view of an individual electrode assembly 72 that may be used in an electrolyzer cell 36 is shown in FIG. 5. In contrast to the diaphragm assembly 70, the hollow rim 76 of the electrode assembly 72 is formed from two plastic rings that have been formed into a single hollow structure. The hollow rim 76 encloses the electrode plate 46 that forms the electrode of the electrolyzer cell 18. Apertures are molded into the hollow rim 76 to form the fluid channels 34, 35, 60, and 64 when placed in aligned contact with adjoining diaphragm assemblies 70. Molded channels in each side of the hollow rim 76 are configured to direct the flow of electrolyte solution 22 across the anodic and cathodic surfaces of the electrode plate 46. More specifically, as shown in FIG. 5, the anodic surface inlet channel 52 couples the anodic inlet channel 34 to the anodic surface 48 of the electrode plate 46, while the anodic surface outlet channel 58, molded into the hollow rim 76 opposite the anodic surface inlet channel 52 couples the anodic surface 48 of the electrode plate 46 to the oxygen outlet channel 60. The design of the electrode assembly 72 is further illustrated by the cross sectional views presented in FIGS. 6-8, which are taken along the lines indicated in FIG. 5.

Figure 6:
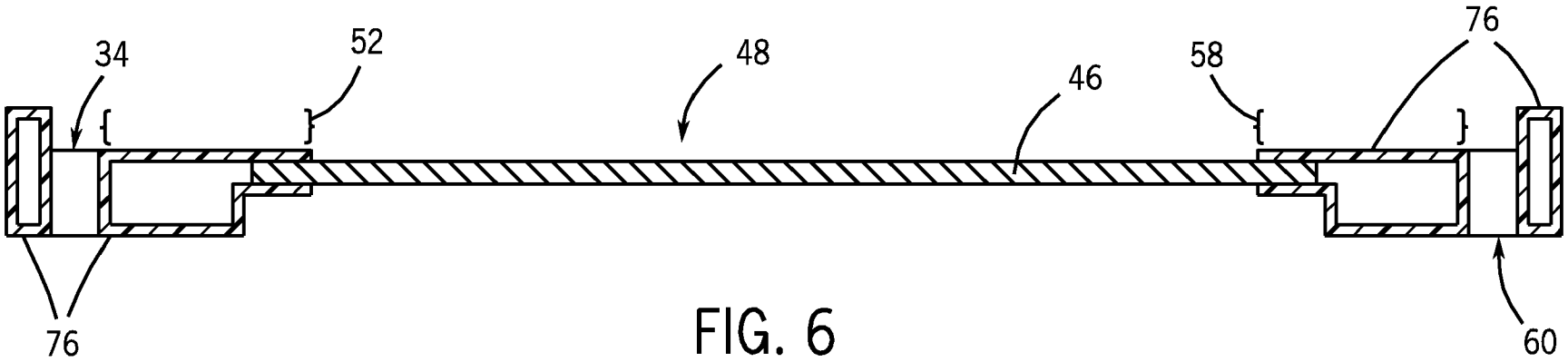
FIG. 6 is a cross section of the electrode assembly of FIG. 5.

A cross sectional view taken through the electrode assembly 72 along line 6 is shown in FIG. 6. In this figure, the electrode plate 46 is enclosed in the hollow rim 76. Apertures molded into the hollow rim 76 form the anodic inlet channel 34 and the oxygen outlet channel 60. Space molded into the surface of the hollow rim 76 forms the anodic surface inlet channel 52, which is coupled to the anodic inlet channel 34, and is configured to direct the flow of electrolyte solution 22 across the anodic surface 48 of the electrode plate 46. An anodic surface outlet channel 58 is configured to direct the flow of the electrolyte solution 22 and entrained bubbles of oxygen 16 to the oxygen outlet channel 60.

Figure 7:
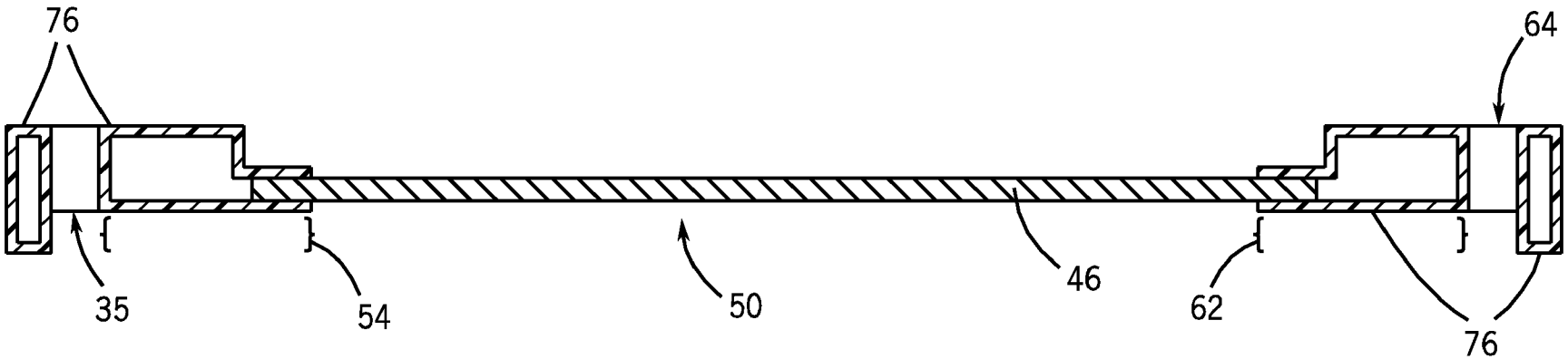
FIG. 7 is a cross section of the electrode assembly of FIG. 5.

Similarly, a cross sectional view of the electrode assembly 72 of FIG. 5 taken along line 7 is shown in FIG. 7. As shown in this cross section, apertures molded into the hollow rim 76 in this direction form the cathodic inlet channel 35 and the hydrogen outlet channel 64. Space molded into the surface of the hollow rim 76 forms the cathodic surface inlet channel 54, which is coupled to the cathodic inlet channel 35, and is configured to direct the flow of electrolyte solution 22 across the cathodic surface 50 of the electrode plate 46. The cathodic surface outlet channel 62 is molded into the hollow rim 76 and is configured to direct the flow of the electrolyte solution 22 and entrained hydrogen 14 to the hydrogen outlet channel 64.

Figure 8:
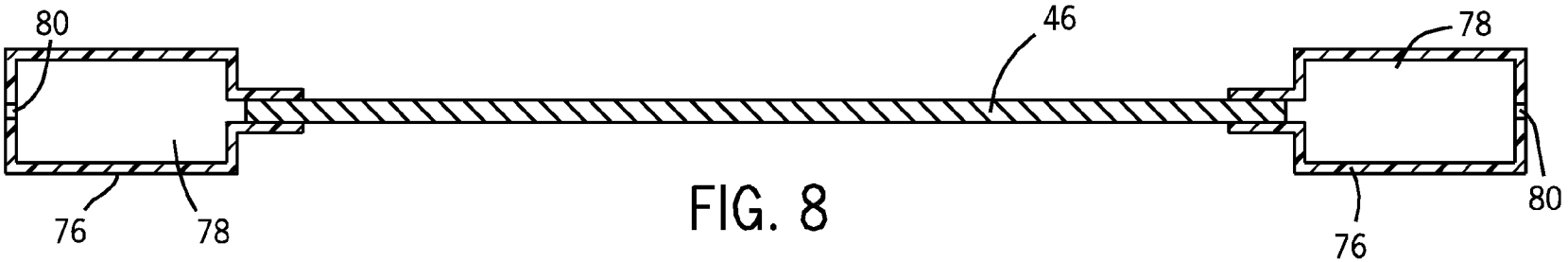
FIG. 8 is a cross section of the electrode assembly of FIG. 5.

A third cross sectional view, taken through the electrode assembly 72 along line 8 is shown in FIG. 8. As for the previous views, the hollow rim encloses the electrode plate 46. However, no channels or apertures are molded into the hollow rim 76 at this point in the circumference. Accordingly, the hollow rim 76 has a single profile extending to the outer edge. The hollow space 78 enclosed within the rim is clearly seen in this figure, and is contiguous with the hollow spaces shown within the hollow rim 76 in the previous figures.

Since the hollow rim 76 is made of a thin layer of plastic enclosing the hollow space 78, pressure to the exterior surface of the hollow rim 76 may cause the hollow rim 76 to collapse. This may be mitigated by forming one or more apertures 80 that will permit communication of a fluid outside the hollow rim 76 of the electrode assembly 72 with the hollow space 78 within the hollow rim 76 of the electrode assembly 72. The apertures 80 may be formed after the thermoforming process, for example, by drilling one or more holes in the outer circumference of the hollow rim 76. In other contemplated embodiments, the apertures 80 may be formed during molding, such as by a protrusion inserted between the plastic sheets when the mold is closed. Alternatively, in other contemplated embodiments, no apertures may be provided. In these embodiments, the hollow space 78 may be filled with a fluid after molding and sealed to form a substantially non-compressible hollow rim 76.

As previously discussed, the space outside of the electrolyzer stack 18 may be filled with a non-conductive fluid. The non-conductive fluid may also be placed in fluidic contact with an outlet channel 60, 64 from the stack, for example, through a volume compensation member in communication with both the outlet channel 60, 64 and the space surrounding the electrolyzer stack 18. As the space outside of the electrolyzer stack 18 is in communication with the hollow space 78 through the apertures 80, using this technique may equalize the pressure within the hollow rim 78 and the inside of the electrolyzer stack 18, further protecting the hollow rim 76 from collapse.

Figure 9:
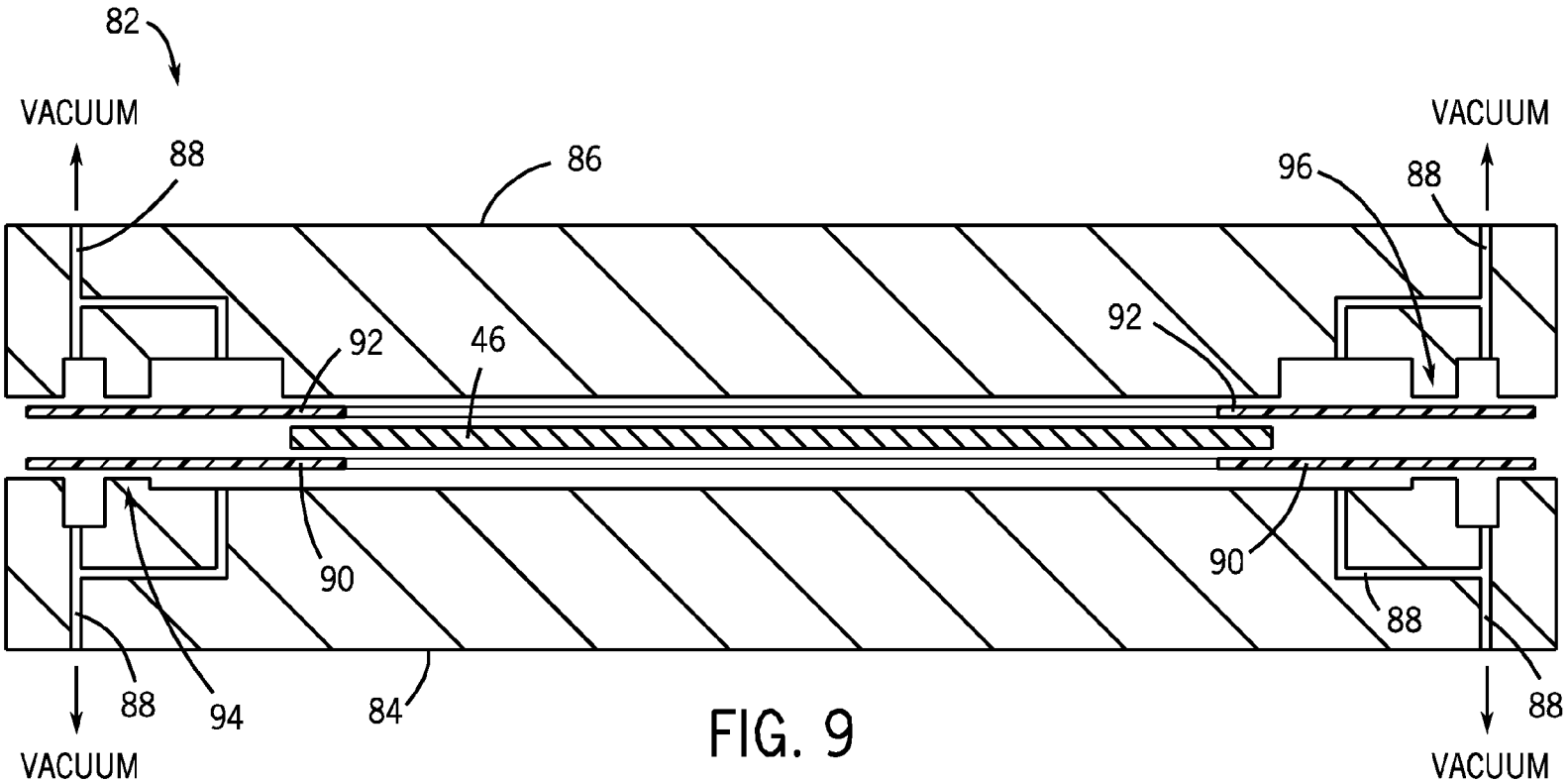
FIG. 9 is a cross section view of a mold that may be used to form an electrode assembly according to an embodiment of the present techniques.

A cross sectional view of a mold 82 that may be used to form the electrode assembly 72 is illustrated in FIG. 9. This view shows the appearance of the mold 82 as it would be shaped in order to form the hollow rim 76 along the sectional view of FIG. 7, i.e., along line 7 in FIG. 5. As illustrated, the mold 82 has a lower section 84 that has the profile of one side of the hollow rim 76 of the electrode assembly 72. The upper section 86 has the profile for the opposing side of the hollow rim 76. Both mold sections 84, 86 will generally include vacuum lines 88 configured to pull a softened plastic sheet into contact with the mold 82. The electrode assembly 72 may be formed by placing a lower plastic ring 90, electrode plate 46, and upper plastic ring 92 into the mold generally following the procedure discussed below. In this cross sectional illustration, a first set of protrusions 94 may form the cathodic inlet channel 35, while a second set of protrusions 96 may be used to form the hydrogen outlet channel 64. The cathodic surface inlet channel 54 and the cathodic surface outlet channel 62 are formed by the lower section 84 of the mold 82, which has minimal indentations on the inside of the protrusions 94, 94 and thus prevents any plastic from blocking flow to the channels 35, 64.

Figure 10:
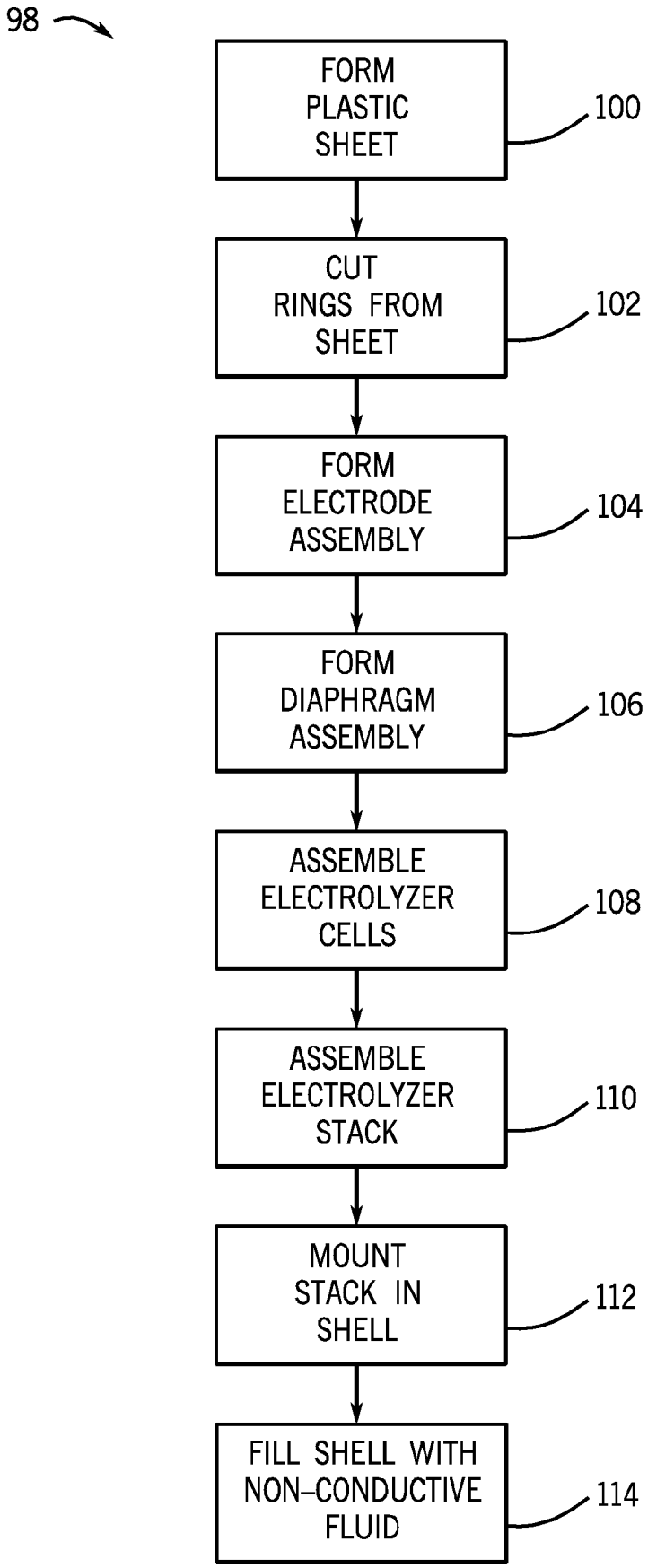
FIG. 10 is a flow chart of a method that may be used to make an electrolyzer assembly according to an embodiment of the present techniques.

The mold 82 discussed above may be used to form an electrode assembly 72 following the process 98 shown in the flow chart of FIG. 10. The process 98 begins in block 100 with the formation of a plastic sheet. The plastic sheet may be made using any number of techniques known in the art, such as sheet extrusion or calendaring, among others. The plastic rings 90, 92 may be cut from the sheet, as indicated by block 102. Each plastic ring will generally have the same outer and inner diameter to form a smooth sided stack when aligned. Similarly, plastic rings used to form the plastic rim 74 of the diaphragm assemblies, 70 may be cut from the sheet and will have an inner and outer diameter that is calculated to match the diameters of the hollow rim 76 of the electrode assembly after forming.

The plastic rings 90, 92 are then used to form the electrode assembly 72 (block 104) generally following the procedure discussed with respect to FIG. 11 below. A similar procedure may be used to form the diaphragm assembly 70 (block 106). The formed assemblies 70, 72 may be joined together to form an electrolyzer cell 36, as indicated by block 108. In some contemplated embodiments, the electrode assembly 72 and diaphragm assembly 70 are not joined together, but are merely held in place by pressure, as discussed above.

The electrolyzer cells 36 may then be aligned and stacked together to form the electrolyzer stack 18, as indicated in block 110. The individual electrolyzer cells 36 may be permanently fused together, or may be held together by pressure as previously discussed. The aligned electrolyzer stack 18 may then be mounted in a shell (block 112), such as shown in FIG. 2, to form an electrolyzer 68. Generally, space will be left between the electrolyzer stack 18 and the shell, allowing thermal expansion to occur without damaging the electrolyzer stack 18. Further protection from damage is provided by filling the shell with a non-conductive fluid, as indicated in block 114.

Figure 11:
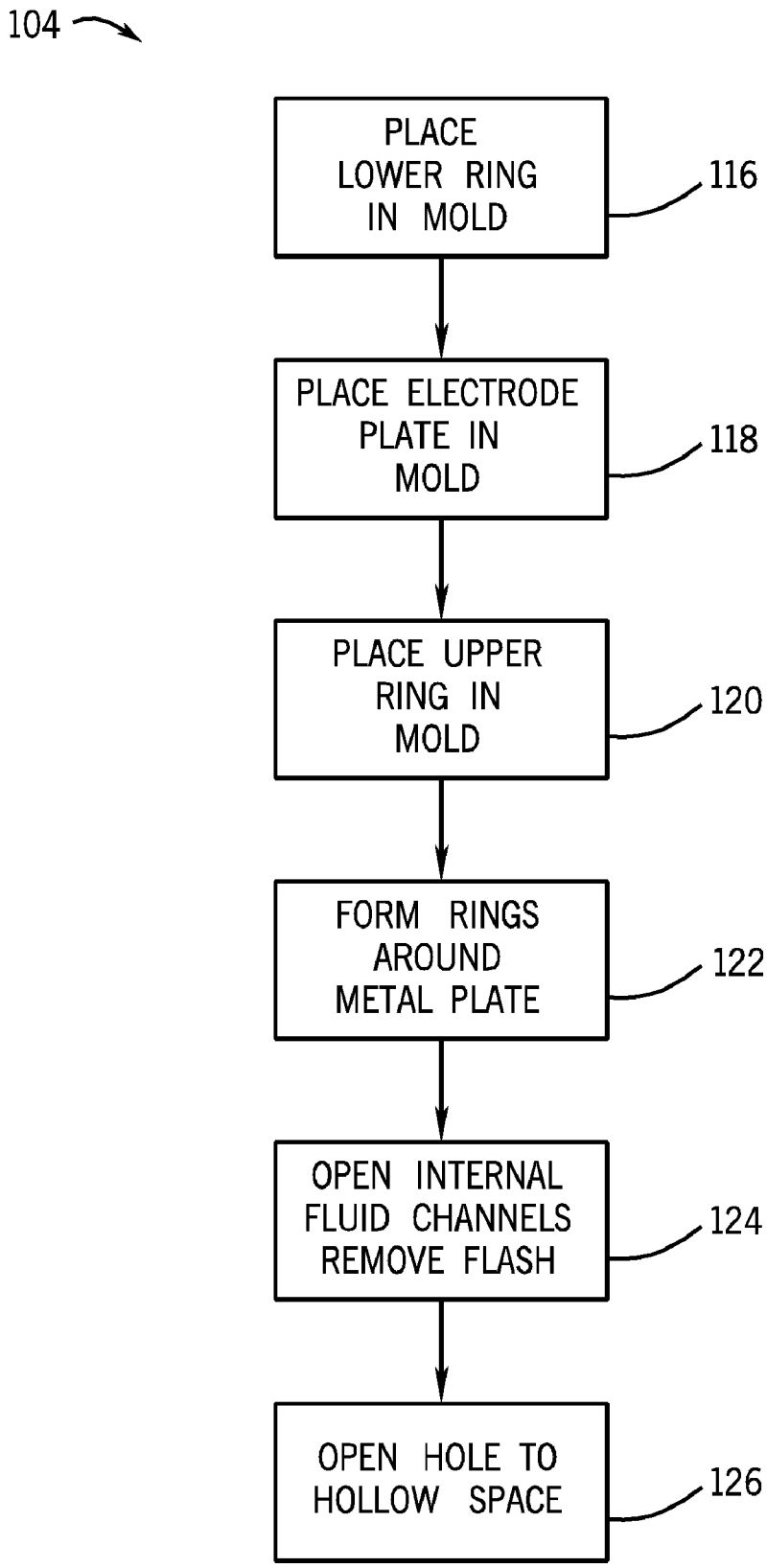
FIG. 11 is a flow chart of a method that may be used to make an electrode assembly according to an embodiment of the present techniques.

A more detailed view of a process 104 that may be used to form the electrode assembly 72 may be shown in the block flow diagram of FIG. 11. The process 104 begins with placing the lower plastic ring 90 in the mold 82, as indicated in block 116. The electrode plate 46 is substantially centered and placed over the lower plastic ring 90, as indicated in block 118. The upper plastic ring 92 is substantially centered and placed over the electrode plate 46, as indicated by block 120. The plastic rings 90, 92 do not necessarily have to be cut from the plastic sheet entirely before forming the electrode assembly 72. For example, in a contemplated embodiment, only the center opening of the ring is cut out before the electrode assemblies 72 is thermoformed. In this embodiment, either the mold 82 or the final trimming process may be used to cut the electrode assembly 72 from the plastic sheet.

After the plastic rings 90, 92 and electrode plate 46 have been placed in the mold, the rings may be thermoformed around the electrode plate 46 to form the electrode assembly 72, as indicated in block 122. The thermoforming process may be carried out in any number of ways known in the art. For example, the upper plastic ring 92 may be held away from the lower plastic ring 90 and electrode plate 46 by a slight vacuum pulled through the vacuum lines 88, while the plastic rings 90, 92 are heated and softened. Once the rings are soft enough, a higher vacuum level may be pulled through the vacuum lines 88 to form the lower ring 90 into the shape of the lower section 84 of the mold 82 and the upper ring 92 into the shape of the upper section 86 of the mold 82. The mold 82 could then be closed to seal the formed plastic rings 90, 92 together, forming the hollow rim 76 of the electrode assembly 72. After forming, the electrode assembly 72 would be cooled to harden the plastic and then removed from the mold 82.

After the finished electrode assembly 72 has been removed from the mold 82, the flash may be trimmed away, as indicated in block 124. This involves cutting the excess plastic from the edges and out of the apertures that form the fluid channels 34, 35, 60, and 64. If the electrode assembly 72 has been molded from continuous sheets of plastic, the electrode assembly 72 may be cut from the plastic sheet in this step.

Lastly, an aperture 80 may be formed into the hollow space 78 within the hollow rim 76 of the electrode assembly 72, as indicated in block 126. This may be performed by any number of procedures, such as by drilling one or more holes in the outer circumference of the electrode assembly 72.

A similar procedure may be used to form the diaphragm assembly 70. However, as each diaphragm assembly 70 is formed from a single plastic ring the liquid permeable membrane 56 may not be placed in the mold during the thermoforming process, but may be attached after the plastic ring is thermoformed into the plastic rim 74 and the flash is trimmed away. For example, the liquid permeable membrane 56 may be attached to the plastic rim by heat sealing, adhesives, ultrasonic welding, or any other suitable technique. Further, the diaphragm assembly 70 does not have to be thermoformed, but may be cut to the correct dimensions and shape directly from the plastic sheet.

While only certain features of the invention have been illustrated and described herein, many modifications and changes will occur to those skilled in the art. It is, therefore, to be understood that the appended claims are intended to cover all such modifications and changes as fall within the true spirit of the invention.

What is claimed is:

1. A method, comprising:

forming an electrode assembly of an electrolyzer cell by thermoforming two rings around an electrode plate; and forming an aperture in an outer surface of each electrode assembly leading into a hollow space between the thermoformed rings, wherein the aperture is configured to permit substantially equalizing a pressure within the hollow space with a pressure on the exterior surface of a stack in which the electrode assembly is placed.

2. The method of claim 1, further comprising forming a diaphram assembly comprising a ring disposed around a liquid permeable membrane, and disposing the diaphragm assembly adjacent to the electrode assembly to form an electrolyzer cell.

3. The method of claim 2, comprising similarly forming a plurality of electrolyzer cells and assembling the plurality of electrolyzer cells in an aligned stack.

4. The method of claim 3, comprising mounting the stack within a shell, wherein the shell comprises an outlet fluidically coupled to a fluid channel extending through the stack.

5. The method of claim 4, comprising filling an interior space between the stack and the shell with a non-conductive fluid, wherein the non-conductive fluid is in contact with an interior surface of the shell, and an exterior surface of the stack.

6. The method of claim 1, wherein thermoforming the electrode assembly comprises:

placing a lower ring into a mold;

placing the electrode plate over the lower ring;

placing an upper ring over the electrode plate;

heating the lower ring and the upper ring;

reducing a pressure in the mold to draw the rings into a shape of the mold;

closing the mold to join the lower ring to the upper ring; and cooling the mold.

7. An electrolyzer, comprising:

a plurality of electrolyzer cells placed adjacent to one another to form a stack, wherein each electrolyzer cell comprises a thermoformed electrode assembly comprising a formed plastic hollow rim surrounding an electrode plate, and a diaphragm assembly, wherein the diaphragm assembly of each electrolyzer cell is placed adjacent to a thermoformed electrode assembly of another electrolyzer cell; and a fluid channel through the stack formed by an internal structure of each of the electrolyzer cells, wherein the fluid channel comprises an inlet for introducing electrolyte solution into the stack, an outlet for removing a gas formed in the stack, or any combinations thereof.

8. The electrolyzer of claim 7, wherein the thermoformed electrode assembly comprises a plastic material that is chemically resistant to an organic compound, an oxidative environment, a reducing environment, an acidic environment, a basic environment, or any combination thereof.

9. The electrolyzer of claim 7, wherein the thermoformed electrode assembly comprises polyimides, polyamides, polyether ether ketones, polyethylenes, fluorinated polymers, polypropylenes, polysulfones, polyphenylene oxides, polyphenylene sulfides, polyphenylene ethers, polystyrenes, polyether imides, epoxies, polycarbonates, impact-modified polyethylene, impact-modified fluorinated polymers, impact-modified polypropylenes, impact-modified polysulfones, impact-modified polyphenylene oxides, impact-modified polyphenylene sulfides, impact-modified polystyrene, impact-modified polyetherimide, impact-modified epoxies, impact-modified polycarbonates, or any combination thereof.

10. The electrolyzer of claim 7, wherein an interior volume is formed in the plastic rim of each electrode assembly.

11. The electrolyzer of claim 10, comprising at least one aperture in the rim of each electrode assembly to permit communication of a fluid to the interior volume.

12. The electrolyzer of claim 11, comprising a shell enclosing the stack, and wherein a space between an interior surface of the shell and an exterior surface of the stack is substantially filled with a non-conductive fluid, the fluid substantially filling the interior volume of each electrode assembly.

13. A method of assembling an electrolyzer, comprising:

forming an electrode assembly by thermoforming two rings around an electrode plate;

assembling a plurality of electrolyzer cells into an electrolyzer stack, wherein each electrolyzer cell comprises an electrode assembly and a diaphragm assembly; and disposing a shell around the electrolyzer stack, the shell having an outlet aligned with a fluid channel in the stack.

14. The method of claim 13, comprising forming an aperture in an outer surface of each electrode assembly leading into an interior volume between the thermoformed rings.

15. The method of claim 14, comprising filling a space between the stack and the shell with a non-conductive fluid, the fluid substantially filling the interior volume of each electrode assembly.

16. The method of claim 15, comprising fluidically coupling the space with the outlet to substantially equalize a pressure on an interior surface of the stack with a pressure on an exterior surface of the stack.

17. A method for forming an electrode assembly comprising:

placing a lower plastic ring into a mold;

placing an electrode plate over the lower plastic ring;

placing an upper plastic ring over the electrode plate;

heating the lower plastic ring and upper plastic ring to soften the plastic;

placing a vacuum on the mold to pull the softened plastic into a shape of the mold;

closing the mold to join the lower plastic ring to the upper plastic ring; and cooling the mold to harden the plastic to form the electrode assembly of an electrolyzer cell: and forming an aperture in an outer surface of the electrode assembly leading into a hollow space within a plastic rim of the electrode assembly, wherein the opening is configured to permit substantially equalizing a pressure within the hollow space with a pressure on the exterior surface of the stack.

18. The method of claim 17, comprising attaching a metal member to a surface of the electrode plate to increase a surface area of the electrode plate, wherein the metal member comprises a wire mesh, a wire gauze, a porous surface, or any combination thereof

* * * * *